US005337772A

United States Patent [19]

Habchi

[11] Patent Number: 5,337,772

[45] Date of Patent: Aug. 16, 1994

[54] SELF-UNFOLDING SHELTER

[76] Inventor: Elie E. Habchi, 474 Murray Dr., El Cajon, Calif. 92020

[21] Appl. No.: 46,081

[22] Filed: Apr. 12, 1993

[51] Int. Cl.[5] ..... E04H 15/40

[52] U.S. Cl. ..... 135/104; 135/109; 135/905

[58] Field of Search ..... 135/102, 104, 105, 106, 135/109, 905, 906, 115

[56] References Cited

U.S. PATENT DOCUMENTS

| | | | |
|---|---|---|---|
| 3,990,463 | 11/1976 | Norman | 135/104 |
| 4,858,634 | 8/1989 | McLeese | 135/102 X |
| 5,014,728 | 5/1991 | Arnold | 135/104 |
| 5,038,812 | 8/1991 | Norman | 135/104 |
| 5,137,044 | 8/1992 | Brady | 135/106 X |
| 5,163,461 | 11/1992 | Ivanovich et al. | 135/104 |
| 5,249,592 | 10/1993 | Springer et al. | 135/106 X |

*Primary Examiner*—Carl D. Friedman
*Assistant Examiner*—Lan C. Mai
*Attorney, Agent, or Firm*—Thomas J. Tighe

[57] ABSTRACT

A shelter has a framework of resilient wire in two separate closed loops. Both loops have a memory urging them to lie circularly in a flat plane. Each loop is elongated with one longitudinal end portion partially curled back toward an opposite end portion with the curled end portion being an arch for providing vertical support and the opposite end portion being a generally U-shaped footing member. One loop extends through the other, preferably symmetrically, such that the footing members are opposingly disposed in relation to each other to provide generally planar footing support for the shelter, e.g. the footing members are substantially coplanar with the closed ends of their U-shapes facing outward in opposite directions, and such that the support arches are opposingly aligned and spaced apart, the spacing defining the width of the shelter's ceiling. The loops are kept curled and held in relation to each other by restraining sleeves which are affixed to the external surface of an envelope which at least partially encloses a volume defined by the framework. The respective memories in the loops urging them to outwardly uncurl in opposite directions act to keep the envelope taut.

12 Claims, 4 Drawing Sheets

SELF-UNFOLDING SHELTER

BACKGROUND OF THE INVENTION

This invention relates in general to self-supporting, temporary shelters having a forcefully foldable frame made entirely of separate resilient wire loops, having an envelope which encloses at least a portion of a volume defined by the frame, and having a balancing of tensile forces between the frame and the envelope by which the form of the shelter is achieved.

U.S. Pat. No. 4,858,634 by McLeese presents a self-erecting tent structure having an elliptical base loop and at least a second loop formed in the shape of a saddle clamped to the base loop, the high ends of the saddle providing arches for vertical support. This structure is illustrated in FIG. 22. The patent discloses that the low ends of the saddle loop are attached to the base loop at at least two points. FIG. 22 illustrates that the saddle is attached to the base loop at at least four points, two on each side. There are several disadvantages to this configuration. In practice, the clamps attaching the saddle loop to the base loop have tremendous forces exerted against them when the structure is folded. These tremendous forces almost invariably release the clamps causing dis-attachment of the saddle loop from the base loop. Moreover, the memories of the loops do not apply tension to the fabric comprising the sides of the tent because there are no opposing forces between the saddle loop and the base loop, so the sides tend to sag.

U.S. Pat. No. 5,163,461 by Ivanovich et al., discloses another self-erecting structure but in this case the framework is made from a single loop folded in various ways to provide a footing and vertical support arches. FIG. 1 illustrates a shelter in which the single loop is folded so as to have an elliptical base and a saddle-shaped superstructure. However, this configuration has several disadvantages. The forces applied by the memory of the loop are asymmetrical due to differences in how the superstructure and the base loop come together at the front and back of the structure. At the front, there is a crossing of the loop's wire whereas at the back, the saddle dips down to meet the base loop and is clamped to the base loop. Because of this arrangement, the memory in the superstructure tends to drive the back end of the saddle downward past the base loop, and that is apparently why clamping is necessary. Thus, at the back of the structure, there is no lifting tension on the covering fabric and so the fabric near the juncture of the back end of the saddle and the base loop tends to sag. If the tent has a fabric flood barrier around its base, as most tents do, this sagging tends to lower the height of the flood barrier with obviously disadvantageous results. This sagging is even more so when the clamping between the saddle and the base becomes disengaged, as it easily can because of the large forces applied to the clamps during folding. Another disadvantage is that the connector which couples the ends of the loop's wire together to close the loop is located and exposed at the entrance of the structure. (See FIG. 3, item 5). If a wire end becomes disengaged from the connector, it can create a hazardous condition.

As will be more fully explained in the description of the preferred embodiment, this invention uses two independent, resilient wire loops to impart more uniform and symmetrical tensile forces to the envelope, typically fabric, to keep it taut, including the lower rim of the envelope where a flood barrier is typically located.

Moreover, the cost of manufacturing and maintenance of such shelters is reduced because of, among other things, the lack of any need to clamp the loops together.

Other advantages and attributes of this invention will be readily discernable upon a reading of the text hereinafter.

SUMMARY OF THE INVENTION

An object of this invention is to provide a self-unfolding shelter, such as a tent or sunshade or the like, that has two non-coupled loops of resilient wire as framework members.

Another object of this invention is to provide such a self-unfolding tent in which sleeves affixed to an envelope capture the loops and hold them in their proper forms and in relation to each other without the need for clamps.

A further object of this invention is to provide a tent as described in the preceding two paragraphs in which the bias in one loop acts against the bias in the other loop through the capturing sleeves to symmetrically impart tensile forces to, and throughout, the envelope.

A further object of this invention is to provide a way to locate the connectors used for coupling the ends of resilient wire used in the framework of such shelters well within a sleeve, especially for safety reasons.

A further object of this invention is to provide a safer and more secure connector for coupling the ends of resilient wire used in the framework of such shelters.

A further object of this invention is to provide a resilient wire framed shelter without the disadvantages of the prior art as previously explained.

These, and other objects which will be apparent from a reading of this application, are accomplished by a shelter including a frame encompassing a volume and an envelope, supported by the frame, for enveloping at least a portion of the volume. The frame comprises: (1) a first closed, elongated loop of wire having a memory urging the first loop to lie in a flat plane, the first loop having one longitudinal end portion partially curled back squarely toward an opposite end portion, the curled end portion being a first arch for providing vertical support, the opposite end portion being a first, generally U-shaped footing member and (2) a second closed, elongated loop of wire having a memory urging the second loop to lie in a flat plane, the second loop having one longitudinal end portion partially curled back squarely toward an opposite end portion, the curled end portion being a second arch for providing vertical support, the opposite end portion being a second, generally U-shaped footing member. The first loop extends through the second loop such that the footing members are opposingly disposed in relation to each other to provide generally planar footing support for the shelter, and such that the first and second arches are opposingly aligned and suitably spaced apart. The frame further comprises means acting against the loops' memories for fixing the first and second loops in their respective curled forms, and means for fixing the loops in relation to each other. Preferably both fixing means are a part of the envelope, e.g. the means for fixing can be sleeves externally affixed to the envelope which capture at least portions of the loops, the disposition of the sleeves in which the first loop is captured in relation the disposition of the sleeves in which the second loop is captured determining the extent to which the loops are curled and the positions of the loops in relation to each other. Preferably the loops also have memory urging them to assume a circular shape, and the envelope acting through the sleeves constrains the loops in their elongated forms.

DESCRIPTION OF THE PREFERRED EMBODIMENT

Figure 1:
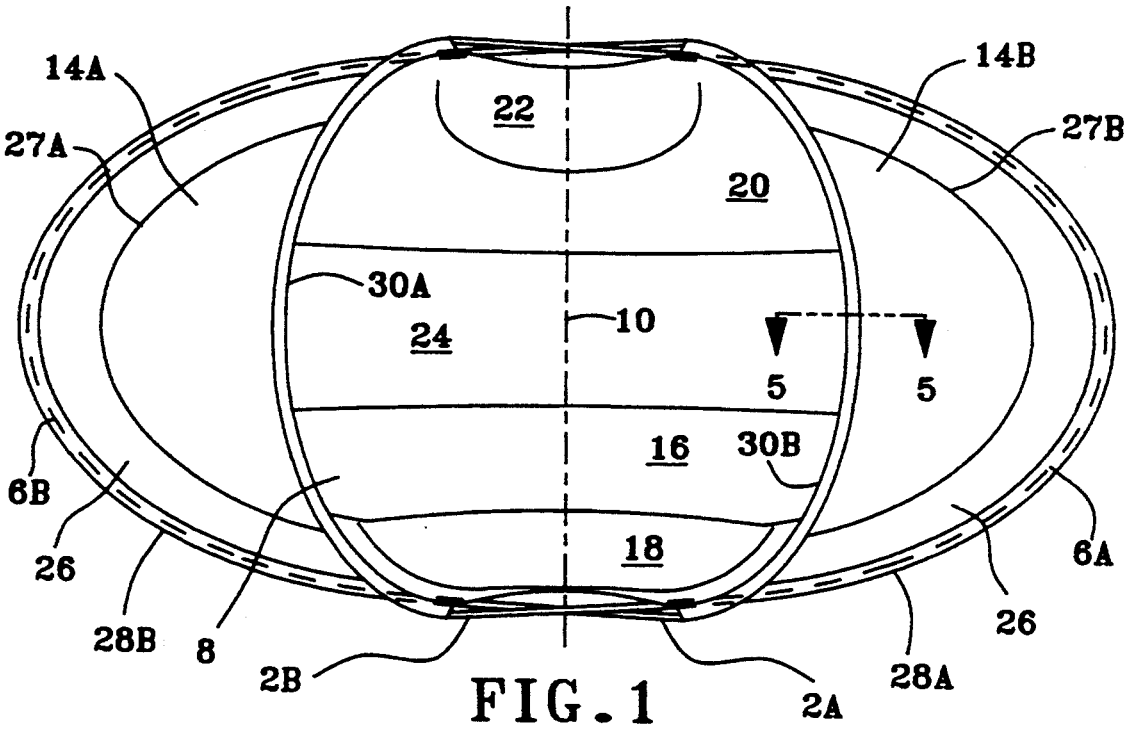
FIG. 1 is a plan view of a shelter according to this invention.
Figure 2:
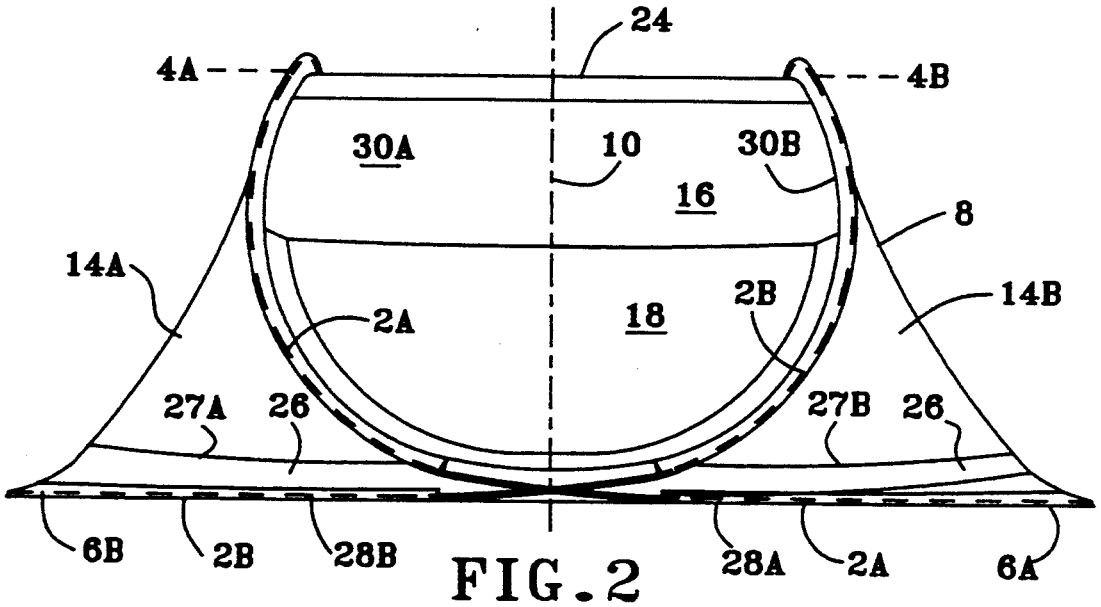
FIG. 2 is a front elevational view of the shelter according to this invention.

As used hereinabove and hereinafter, the term "elongated" when referring to a loop characterizes the loop as having a long, i.e., longitudinal axis, and loops so characterized include without limitation loops that are elliptical, broadly elliptical, oval, oblong, elongated circular and elongated rectangular. As used hereinabove and hereinafter, the term "wire" refers not only metal wire but includes without limitation wire made from fiberglass and other materials which in wire form can have the strength and resilience necessary for this invention.

Referring to FIGS. 1–4, a shelter according to this invention in the form of a tent is illustrated. The tent has a framework consisting of two separate closed loops, 2A and 2B, of resilient wire. Preferably the loops are of equal dimension and each have a memory urging them to lie circularly in a flat plane. Loops made, for example, from OTMB Class II steel wire exhibit these properties. Against its memory, a first loop 2A is constrained into an elongated form with one longitudinal end portion 4A partially curled back squarely toward an opposite end portion 6A. The first loop's curled back portion 4A functions as a first arch for providing vertical support for a fabric envelope 8, and the opposite end portion 6A which remains substantially uncurled functions as a generally U-shaped footing member. Likewise, a second loop 2B is constrained against its memory into an elongated form with one longitudinal end portion 4B partially curled back squarely toward an opposite end portion 6B. Preferably the elongated and curled forms of the loops are substantially identical. The second loop's curled back portion 4B functions as a second arch for providing vertical support for the envelope, and the opposite end portion 6B which also remains substantially uncurled functions as a generally U-shaped footing member.

It should be understood that the designations herein such as "first" and "second" are only arbitrary designations made for purposes of clarity only, and any similar designations made in the claims do not necessarily correspond to these designations.

Referring again to FIGS. 1–4, the first loop extends through the second loop in a way that the footing members are opposingly disposed and cooperate to provide generally planar footing support for the shelter. As illustrated the footing members are substantially coplanar with the closed ends of their U-shapes facing outward in opposite directions. The support arches are also opposingly aligned and suitably spaced apart. As illustrated, the arches are in opposing relation to each other because they curve in opposite directions and therefore exert bias in opposite directions, and they are aligned because they squarely face each other. The arches are suitably spaced apart when they provide a desired ceiling width in relation to the overall size of the shelter. The footing members extend outwardly beyond the arches to provide a footing much larger in area than the area between the arches. Since preferably the size and the forms of the loops are substantially identical, an imaginary median plane 10 cutting through the center of the shelter front to back would divide the shelter into halves that are substantially mirror images of each other, i.e., the arches would mirror each other and their respective apexes would be equally spaced from the median plane, and the footing members would mirror each other.

Referring again to FIGS. 1–4, a front side crossing of the two loops, generally designated 12A, and a backside crossing of the two loops, generally designated 12B, are illustrated. The choice of which loop extends through the other is arbitrary and although the first loop 2A is illustrated as extending through the second loop 2B, it should be understood that the reverse can be true. Also, if one of the loops can be opened, the loops can be arranged to have one segment of each loop extend through the other loop.

Referring again to FIGS. 1–4, the framework described above defines a volume of space and an envelope supported by the framework encloses at least a portion of that volume. The fabric envelope 8 of the illustrated tent embodiment consists of a plurality of water repellent panels, namely: two side panels, 14A and 14B, a front panel 16 including an entrance flap 18, a rear panel 20 including a window flap 22, and a ceiling panel 24. At the base of the tent is a waterproof floor panel (not shown) and a waterproof flood barrier panel 26. The floor panel covers an elongated area and closes the base of the volume. The flood barrier panel completely surrounds floor panel and is affixed to the margin of the floor panel by a conventional seam (not shown) and to the bottom margins of the side, front and back panels, also by conventional seams, 27A and 27B.

Referring again to FIGS. 1–4, also affixed to the margin of the floor panel at opposite long ends are two footing sleeves, 28A and 28B, in which are captured the footing members, 6A and 6B respectively. Each of these footing sleeves is preferably co-extensive with the footing member captured by it except for gaps at the front and back loop crossings, 12A and 12B. In operation each footing sleeve constrains its captured footing member to conform to that portion of the floor panel to which the sleeve is affixed.

Referring again to FIGS. 1–4, the first and second arches, 4A and 4B, are captured by first and second arch sleeves, 30A and 30B respectively. The first arch sleeve is affixed to and follows a conventional seam (not shown) between a first side panel 14A and the front, back and ceiling panels. The second arch sleeve is affixed to and follows a conventional seam (not shown) between a second side panel 14B and the front, back and ceiling panels. Each arch sleeve is preferably coextensive with the arch captured by it except for gaps at the front and back loop crossings, 12A and 12B.

Figure 5:
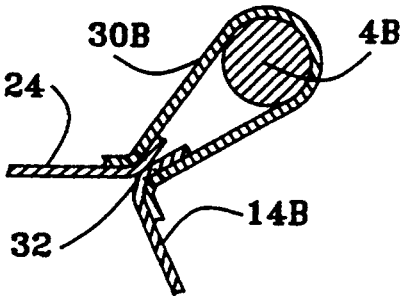
FIG. 5 is a cross-sectional view taken along line 5—5 of FIG. 1.

Referring to FIG. 5, the second arch sleeve 30B is illustrated in cross-section with the second arch 4B captured therein. A loose fitting between the arch and the sleeve is preferable. The sleeve is affixed to the envelope at a seam 32 between the second side panel 14B and the ceiling panel 24. This sleeve is typical of the other sleeves.

Figure 6:
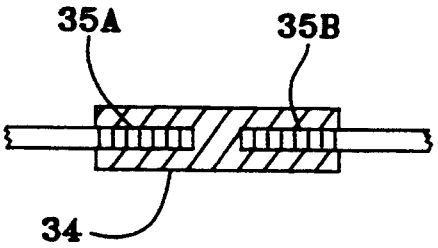
FIG. 6 is a cross-sectional view of a coupling sleeve illustrated as item 34 in FIG. 3.
Figure 3:
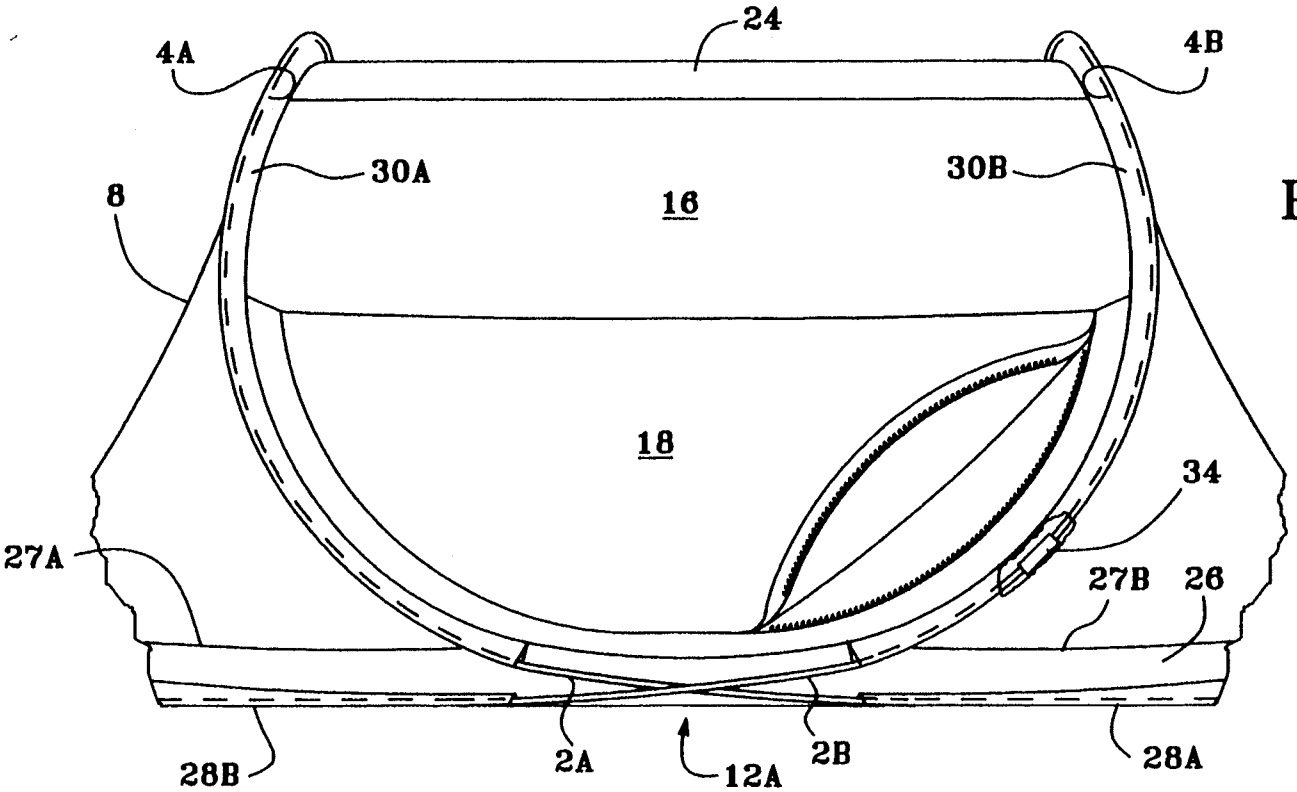
FIG. 3 is a detail view of the front of a shelter according to this invention.
Figure 4:
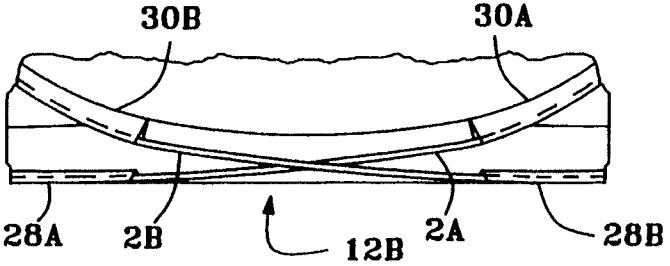
FIG. 4 is a detail view of a portion of the rear of a shelter according to this invention.

Referring to FIGS. 3 and 6, a connector 34 is illustrated as coupling opposite ends of a wire to form the second loop 2B. From an assembly standpoint it is preferable to pass the loop wires through their respective sleeves before closing the loops. This connector and another like it for the other loop enable such an assembly procedure. The location of the connector should be noted. Since the loops are not coupled or clamped together but are merely constrained by loose fitting sleeves, the loops can be rotated through their respective sleeves to move the location of the connectors to well within a sleeve. In this way the connectors can be hidden both for aesthetic reasons, but more importantly for safety reasons. If a wire end becomes disengaged, any whipping movement of the end will be inhibited by the surrounding sleeve, and unless the end tears through the sleeve, the end will not be exposed.

Preferably the connectors couple the ends of the loops turnbuckle style, i.e., each connector has oppositely threaded bores, 35A and 35B, at both ends and the ends of the loop wires are oppositely threaded to engaged the connector such that when axially turning the connector in one direction both wire ends are being screwed into the connector, and when turning the it in the opposite direction the ends are being screwed out of the connector. This is a much safer way to couple the wire ends than has been presented in the prior art which discloses one end of a wire affixed in a connector but the other end simply inserted in the connector and held there only by the bias in the wire. (See FIG. 2 of U.S. Pat. No. 5,163,461 by Ivanovich et al.)

In operation, the bias in one loop acts against the bias in the other loop through the capturing sleeves and the envelope. The ceiling panel tethers the apexes of the arches together channeling their opposing biases against each other. The floor panel tethers the footing members together channeling their opposing biases against each other. The side panels tether the arches and the footing members together channeling their opposing biases against each other. In this way the loops are fixed in their curled forms and are fixed in relation to each other. Tension in the envelope front to back is caused by the bias in the loops urging them to assume a circular form. Thus the loops not only exert a longitudinal uncurling bias, but they also exert a radial bias which causes the front and back of the shelter to billow out. All these forces and others not discussed tend to keep all portions of the envelope taut, and to especially keep the flood barrier panel erect.

It should be understood that the forms of the loops, their disposition in relation to each other, and their interaction as described above assumed no external forces were applied to the shelter except gravity. External forces applied to the shelter, such as wind, can alter the forms of the loops and change other relationships described above without departing from the scope of the inventions claimed herein.

Figure 7B:
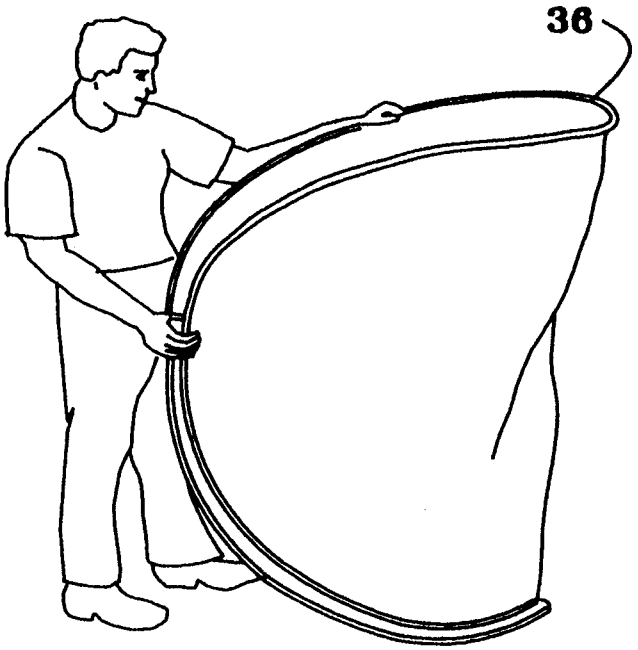
FIGS. 7A–7E are pictorial illustrations of how a shelter according to this invention is folded.
Figure 7A:
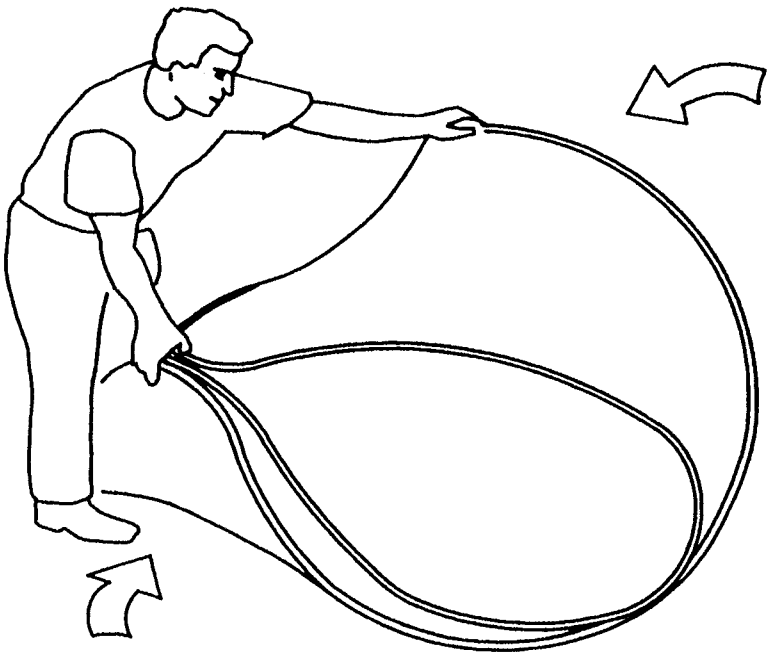
Figure 7D:
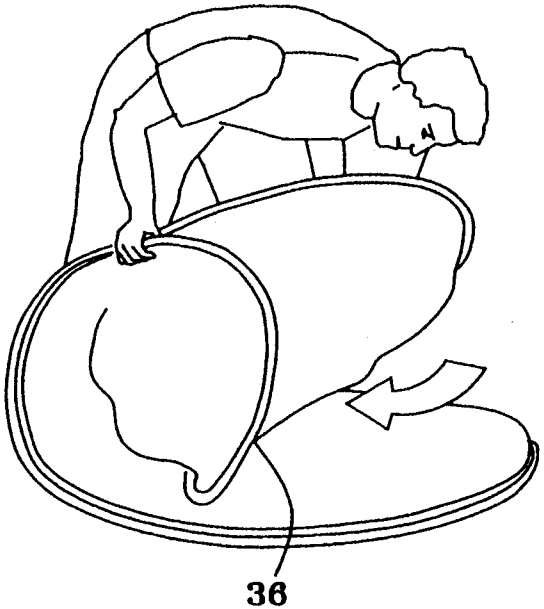
Figure 7E:
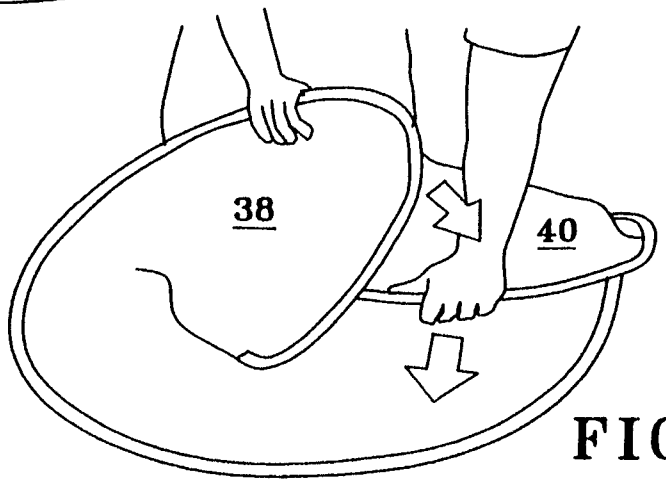
Figure 7C:
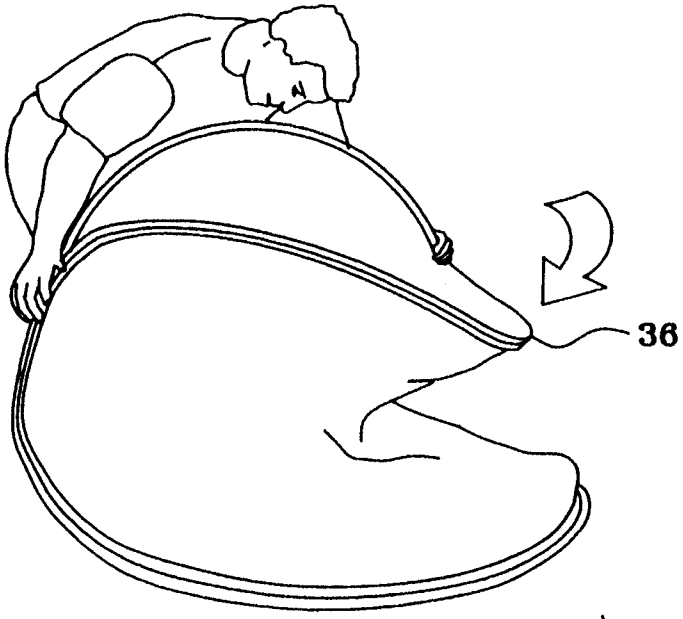

Referring to FIGS. 7A–7E, a method of folding a shelter according to this invention is illustrated. FIGS. 7A and 7B illustrate the steps of bringing the arches and footing members together by folding the shelter across its middle, and standing the folded piece on its end with the bottom of the fold facing away from the folder. FIGS. 7C and 7D illustrate bending the top edge 36 of the fold down toward the ground and tucking the edge 36 inward toward the folder's leg, resulting in two circular sections, 38 and 40. FIG. 7E illustrates the step of folding one of the circular sections underneath the other to create a flat disk which can then be inserted into a bag adapted to hold the shelter in disk form. To unfold the shelter, one simply removes the disk from the bag and lets it go. If folded correctly the shelter will completely unfold by itself.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, although the envelope of the tent embodiment illustrated herein completely encloses the volume defined by the framework, optionally portions of the envelope can be omitted to form other types of structures and shelters. For example, an embodiment for providing shade against the sun can be made by, for example, omitting the front panel and constructing all or portions of the side panels using large gauge mesh fabric to allow free flow of air through the shelter. These changes to the above-disclosed tent embodiment will not significantly alter the balancing of opposing biases of the loops and will not significantly alter the structure of this invention.

I claim:

1. A shelter comprising:

(a) means for framing a volume comprising:

(i) a first closed, elongated loop of wire having a memory urging the first loop to lie in a flat plane, the first loop having one longitudinal end portion partially curled back squarely toward an opposite end portion, the curled end portion being a first arch for providing vertical support, the opposite end portion being a first, generally U-shaped footing member, (ii) a second closed, elongated loop of wire having a memory urging the second loop to lie in a flat plane, the second loop having one longitudinal end portion partially curled back squarely toward an opposite end portion, the curled end portion being a second arch for providing vertical support, the opposite end portion being a second, generally U-shaped footing member, the first loop extending through the second loop, the first and second footing members being opposingly disposed in relation to each other to provide generally planar footing for the shelter, and the first and second arches being opposingly aligned and suitably spaced apart, (iii) means for fixing the first and second loops in their respective curled forms, and (iv) means for fixing the loops in relation to each other, and (b) means, supported by said means for framing, for enveloping at least a portion of said volume.

2. The shelter according to claim 1 wherein both means for fixing comprise a first sleeve means for capturing the first loop, a second sleeve means for capturing the second loop, both sleeve means being affixed to an external surface of said means for enveloping, dimensions of said means for enveloping and the disposition of the first sleeve means in relation the disposition of the second sleeve means cooperating to fix the loops in their respective curled forms and to fix the loops in relation to each other.

3. The shelter according to claim 2 further comprising means for coupling the ends of a loop to close it, said means being disposed within a sleeve means in which said loop is captured.

4. The shelter according to claim 3 wherein said means for coupling comprises a turnbuckle.

5. The shelter according to claim 1 wherein the footing members are substantially coplanar and aligned with the closed ends of their U-shapes facing outward in opposite directions.

6. The shelter according to claim 1 further comprising turnbuckle means for closing the loops.

7. A shelter comprising:

(a) means for framing a volume comprising:

(i) a first closed, elongated loop of wire having a memory urging the first loop to lie circularly in a flat plane, the first loop being elongated with one longitudinal end portion partially curled back squarely toward an opposite end portion, the curled end portion being a first arch for providing vertical support, the opposite end portion being a first, generally U-shaped footing member, (ii) a second closed, elongated loop of wire having a memory urging the second loop to lie circularly in a flat plane, the second loop being elongated with one longitudinal end portion partially curled back squarely toward an opposite end portion, the curled end portion being a second arch for providing vertical support, the opposite end portion being a second, generally U-shaped footing member, the first loop extending through the second loop, the first and second footing members being opposingly disposed in relation to each other to provide generally planar footing for the shelter, and the first and second arches being opposingly aligned and suitably spaced apart, (iii) means for fixing the first and second loops in their respective curled forms, and (iv) means for fixing the loops in relation to each other, and (b) means, supported by said means for framing, for enveloping at least a portion of said volume.

8. The shelter according to claim 7 wherein both means for fixing comprise a first sleeve means for capturing the first loop, a second sleeve means for capturing the second loop, both sleeve means being affixed to an external surface of said means for enveloping, dimensions of said means for enveloping and the disposition of the first sleeve means in relation the disposition of the second sleeve means cooperating to fix the loops in their respective curled forms and to fix the loops in relation to each other.

9. The shelter according to claim 8 further comprising means for coupling the ends of a loop to close it, said means being disposed within a sleeve means in which said loop is captured.

10. The shelter according to claim 9 wherein said means for coupling comprises a turnbuckle means.

11. The shelter according to claim 7 wherein the footing members are substantially coplanar and aligned with the closed ends of their U-shapes facing outward in opposite directions.

12. The shelter according to claim 7 further comprising turnbuckle means for closing the loops.

* * * * *